US008640907B1

(12) United States Patent
Herrmann

(10) Patent No.: US 8,640,907 B1
(45) Date of Patent: Feb. 4, 2014

(54) RETROFIT FOR FLOATING ROOF TANKS

(75) Inventor: Gary Herrmann, Findlay, OH (US)

(73) Assignee: Marathon Petroleum Company LP, Findlay, OH (US)

( * ) Notice: Subject to any disclaimer, the term of this patent is extended or adjusted under 35 U.S.C. 154(b) by 652 days.

(21) Appl. No.: 12/655,113

(22) Filed: Dec. 22, 2009

(51) Int. Cl.
*B65D 88/40* (2006.01)

(52) U.S. Cl.
USPC ..... 220/567.2; 220/216; 220/367.1

(58) Field of Classification Search
USPC ..... 220/220, 227, 219, 567.2, 216, 218, 220/221–222, 203.27, 203.19, 367.1
See application file for complete search history.

(56) References Cited

U.S. PATENT DOCUMENTS

| | | | | |
|---|---|---|---|---|
| 3,815,775 | A * | 6/1974 | Strunc et al. | 220/220 |
| 4,260,068 | A | 4/1981 | McCarthy | |
| 4,431,536 | A | 2/1984 | Thompson | |
| 4,512,883 | A | 4/1985 | Thompson | |
| 4,790,447 | A | 12/1988 | Lenny | |
| 4,957,214 | A | 9/1990 | Lenny | |
| 5,305,905 | A | 4/1994 | Zizinia | |
| 5,363,695 | A * | 11/1994 | Jensen | 73/49.2 |
| 5,453,179 | A * | 9/1995 | Stultz | 210/97 |
| 6,224,261 | B1 * | 5/2001 | Stone | 383/119 |
| 6,273,287 | B1 | 8/2001 | Witter et al. | |
| 2004/0016755 | A1 * | 1/2004 | Gilbert et al. | 220/216 |
| 2005/0081925 | A1 * | 4/2005 | Pyle et al. | 137/587 |

* cited by examiner

*Primary Examiner* — J. Gregory Pickett
*Assistant Examiner* — Robert Poon
(74) *Attorney, Agent, or Firm* — Emch, Schaffer, Schaub & Porcello Co., L.P.A.

(57) ABSTRACT

Floating roof tanks typically have a leg-actuated pressure-vacuum vent to provide relief upon emptying or filling the space below the roof. This vent leg must hit prior to other legs requiring additional working capital inventory (heel). This retrofit non-leg actuated pressure vacuum (P-V) vent reduces inventory. This P-V vent retrofit provides necessary pressure or vacuum management and at less required tank bottom inventory. The retrofit vent also eliminates the leg-actuated P-V vent.

3 Claims, 3 Drawing Sheets

RETROFIT FOR FLOATING ROOF TANKS

TECHNICAL FIELD

This invention relates to floating roof liquid storage tanks that are extensively used to store liquid hydrocarbon products such as crude oil, gasoline, and the like. More specifically, the invention relates to a retrofit pressure vacuum vent for floating roof tanks.

BACKGROUND OF THE INVENTION

Oil refineries and storage terminals utilize floating roof tanks for the storage of hydrocarbon stocks which have a high vapour pressure. Typical products are gasoline, naphthas and crude oil.

The filling and emptying of the tanks is between a normal minimum to a normal maximum gauge (or depth) which typically is approximately 2 meters to approximately 14 meters respectively. The minimum gauge elevation is determined by the need to keep the underside of the roof clear of any projections into the tank (e.g. tank heaters, mixers, suction/rundown lines) and the requirement to provide sufficient head for pumping equipment connected to the tank. As all working movements in the tank are above the minimum gauge, the volume in the tank at minimum gauge, (or heel) is a static inventory which represents the high cost of working capital inventory. This liquid must be purchased but cannot be sold as it cannot be extracted from the tank while the tank remains in use.

SUMMARY OF THE INVENTION

Floating roof tanks typically have a leg-actuated pressure-vacuum vent to provide relief upon emptying or filling the space below the roof. This vent leg must hit prior to other legs requiring additional working capital inventory (heel). The retrofit non-leg actuated pressure vacuum (P-V) vent of this invention reduces this inventory.

Extra inventory held in tank bottoms costs money. This gains no interest for the tank owner. If the inventory can be lowered, there is less capital tied up generating no return. Reducing extra inventory in floating roof tanks also avoids accidental leg actuating pressure vacuum vents from opening creating potential hydrocarbon vapor release (environmental impact and potential NOV for emissions).

This invention, P-V vent retrofit, provides necessary pressure or vacuum management and at less required tank bottom inventory. Retrofit costs are well less than the value of inventory saved.

Generally, the floating roof liquid storage tank of this invention comprises a floating roof storage tank; a quantity of volatile product located in the storage tank; a floating roof resting on the volatile product; a roof nozzle extending through the floating roof; a vapor tight seal on the floating roof surrounding the roof nozzle; and a leg-less pressure-vacuum vent located on the floating roof surrounding the roof nozzle.

The method of this invention minimizes the inventory heel of a quantity of volatile product stored in the floating roof liquid storage tank. This method comprises the steps of: eliminating a leg-actuated pressure-vacuum vent; and retrofitting a floating roof liquid storage tank with a leg-less pressure-vacuum vent located on the floating roof of the tank.

Other objects and advantages of the present invention will become apparent to those skilled in the art upon a review of the following detailed description of the preferred embodiments and the accompanying drawings.

BRIEF DESCRIPTION OF THE DRAWINGS

FIG. 1 shows the roof floating.

FIG. 3 shows the pressure vacuum vent for retrofit over a floating roof leg-actuated vacuum breaker vent.

DETAILED DESCRIPTION OF THE INVENTION

In the preferred embodiment, the leg-less vent further comprises a frame supporting a pressure door and a vacuum door. A hinge connects the pressure door to the frame and a hinge connects the vacuum door to the frame. The hinges on the vent doors are fabric hinges.

In a preferred embodiment, the method further comprises the step of: lowering the inventory heel of the volatile product stored in the storage tank.

The method further comprising the step of: providing necessary pressure or vacuum management to the storage tank.

Figure 1:
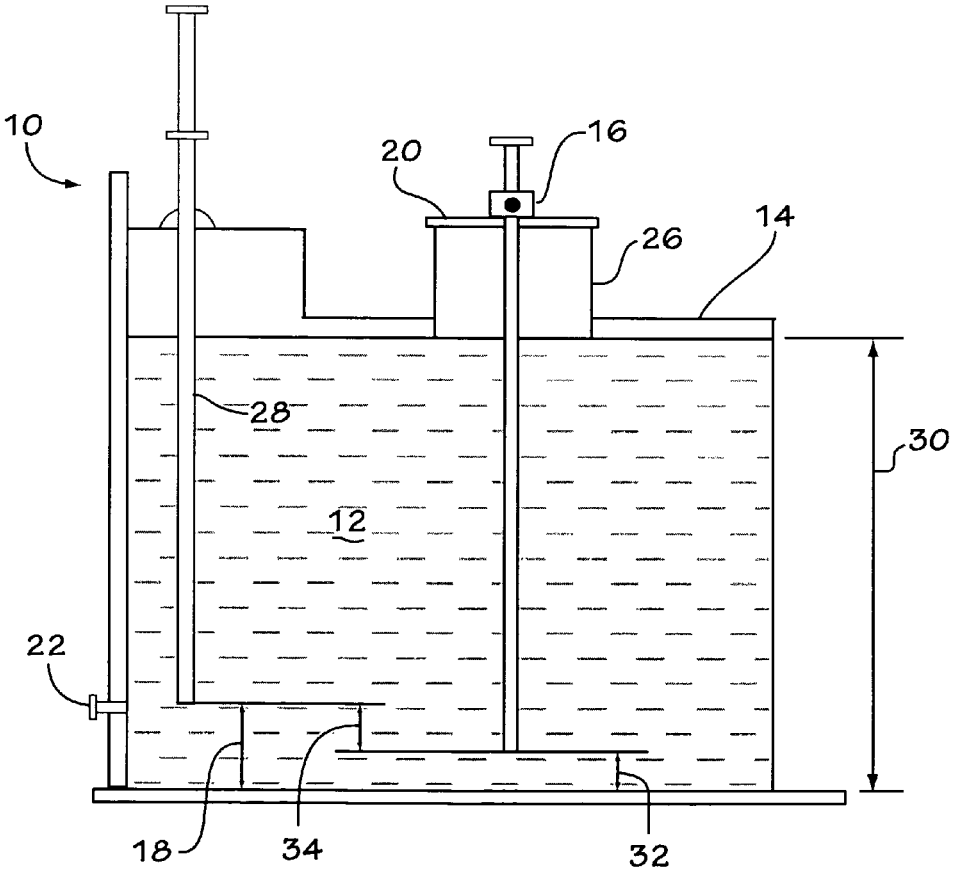
FIG. 1 is a view showing a typical prior art floating roof tank including a conventional leg-actuated pressure-vacuum vent.

FIG. 1 is a view showing a typical prior art floating roof tank including a conventional leg-actuated pressure-vacuum vent. FIG. 1 shows the roof floating. FIG. 1 shows a floating roof storage tank 10 that holds a quantity of volatile product 12 therein. There is a floating roof 14 which rests on the product 12 and which is in contact with the product 12. Leg-actuated pressure-vacuum-vent 16 extends through roof 14 and floats on product 12. There is a vapor tight seal 20 that is mounted on roof 14 at the lower surface thereof which rests on product 12. The seal 20 surrounds the outside of vent 16. The seal moves with roof 14 as the level of product 12 changes. Also shown is inlet fill nozzle 22, vent riser 26 and roof support leg 18.

Also shown in FIG. 1 is the tank minimum depth (30) of heel when leg vent 16 in an upper position. Minimum depth 32 of heel is a safety distance to avoid vent 16 from opening, which would cause vapor emissions. Depth 34 is the distance a vacuum breaker must open before roof 14 lands on it's legs (not shown) to ensure free flow of vapor out of the tank when filling or air flow into the tank when emptying.

Figure 2:
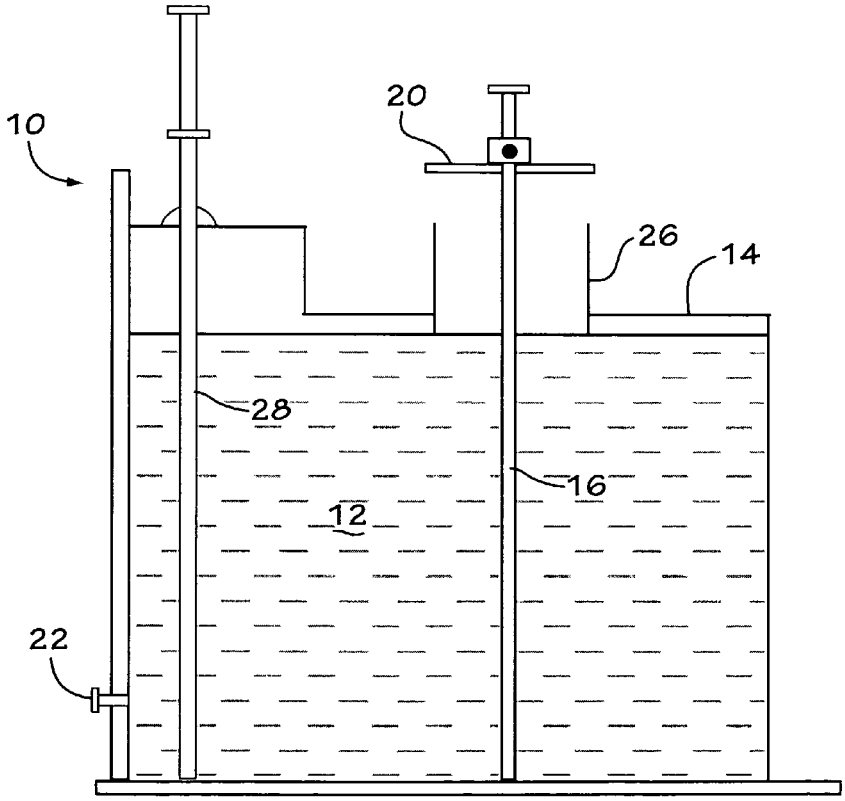
FIG. 2 is a view of the prior art tank of FIG. 1 showing the roof landed.

FIG. 2 is a view of the prior art tank of FIG. 1 showing the roof landed.

Figure 3:
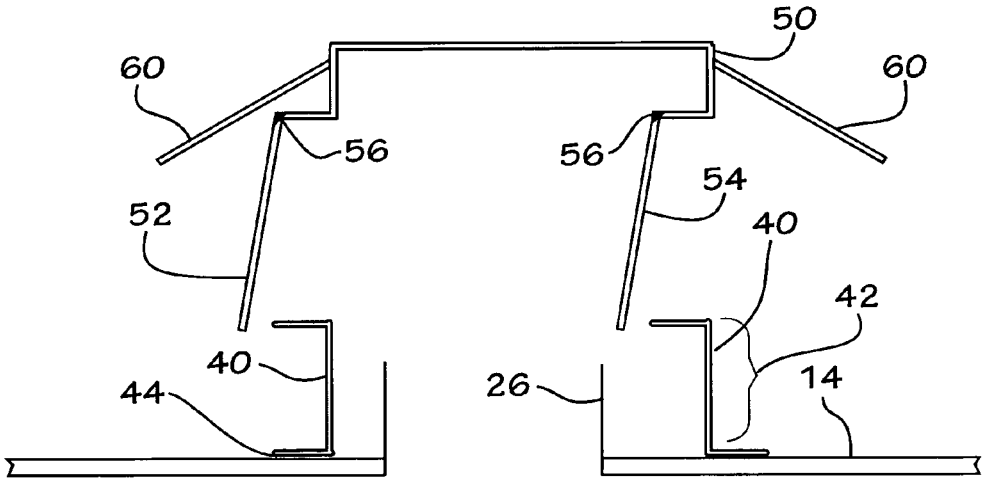
FIG. 3 is a view of the pressure vacuum vent of this invention.

FIG. 3 is a view of the pressure vacuum vent of this invention. FIG. 3 shows the pressure vacuum vent for retrofit over a floating roof leg-actuated vacuum breaker vent nozzle (26).

FIG. 3 shows floating roof tank 10 with P-V vent 16 removed. Also shown is existing floating roof 14 and existing roof nozzle 26. Also shown, the invention nozzle (40) height 42 can be adjusted to accommodate nozzle (26) height. Sealant (44) (butyl rubber or silicone caulk) seals P-V frame 40+50 to floating roof 14. Frame 50 supports pressure door 52 and vacuum door 54. Fabric hinges 56 connect doors 52 and 54 to frame 50. Also shown is rain/snow/ice shield 60 protecting the retrofit P-V system of this invention.

Extra inventory held in tank bottoms cost money and gains no interest for the tank owner. If the inventory can be lowered, there is less capital tied up generating no returns. Reducing extra inventory in floating roof tanks also avoids leg actuating pressure vacuum vents from opening prematurely creating potential hydrocarbon vapor release (environmental impact, loss of valuable inventory and potential NOV for emissions).

This inventive P-V vent retrofit provides necessary pressure or vacuum management and at less required tank bottom inventory. Retrofit costs are well less than the value of inventory saved.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A floating roof liquid storage tank comprising:

a floating roof storage tank;

a quantity of volatile product located in the storage tank;

a floating roof resting on the volatile product;

a roof nozzle extending through the floating roof;

a vapor tight seal on the floating roof surrounding the roof nozzle; and a leg-less pressure-vacuum vent located on the floating roof surrounding the roof nozzle;

wherein the leg-less vent further comprises a frame supporting a pressure door and a vacuum door.

2. A storage tank according to claim 1 wherein a hinge connects the pressure door to the frame and a hinge connects the vacuum door to the frame.

3. A storage tank according to claim 2 wherein the hinges are low friction fabric hinges.

* * * * *